US011248846B2

(12) United States Patent
Katsumata et al.

(10) Patent No.: US 11,248,846 B2
(45) Date of Patent: Feb. 15, 2022

(54) HEAT TREATMENT SYSTEM

(71) Applicants: IHI Corporation, Tokyo (JP); IHI Machinery and Furnace Co., Ltd., Tokyo (JP)

(72) Inventors: Kazuhiko Katsumata, Inuyama (JP); Takahiro Nagata, Kamo-gun (JP)

(73) Assignees: IHI Corporation, Tokyo (JP); IHI Machinery and Furnace Co., Ltd., Tokyo (JP)

( * ) Notice: Subject to any disclaimer, the term of this patent is extended or adjusted under 35 U.S.C. 154(b) by 865 days.

(21) Appl. No.: 15/700,479

(22) Filed: Sep. 11, 2017

(65) Prior Publication Data

US 2017/0370648 A1 Dec. 28, 2017

Related U.S. Application Data

(63) Continuation of application No. PCT/JP2016/058951, filed on Mar. 22, 2016.

(30) Foreign Application Priority Data

Mar. 30, 2015 (JP) ..... JP2015-067959

(51) Int. Cl.
*F27B 9/12* (2006.01)
*F27D 7/00* (2006.01)
(Continued)

(52) U.S. Cl.
CPC ..... *F27B 9/12* (2013.01); *C21D 9/0018* (2013.01); *C21D 9/0062* (2013.01); *C23C 8/20* (2013.01);
(Continued)

(58) Field of Classification Search
CPC ..... F27B 9/12; F27B 2009/124
See application file for complete search history.

(56) References Cited

U.S. PATENT DOCUMENTS 5,143,558 A * 9/1992 Smith ..... C21D 9/0018 148/206
5,624,255 A * 4/1997 Hisada ..... C21D 9/0018 432/128
(Continued)

FOREIGN PATENT DOCUMENTS

CN 102703655 A 10/2012
CN 102844640 A 12/2012
(Continued)

OTHER PUBLICATIONS

Maruyama et al. "Evacuating Device for Vacuum Heat Treating Device", 2007. Machine-translation of JP2007315729A (Year: 2007).*
Hori et al. "Heat Treating Facility", 2008. Machine-translation of JP2008170116A (Year: 2008).*
Katsumata et al. "Thermal Treatment System", 2009. Machine-translation of JP2009236344A (Year: 2009).*

*Primary Examiner* — Alexandra M Moore
(74) *Attorney, Agent, or Firm* — Rothwell, Figg, Ernst & Manbeck, P.C.

(57) ABSTRACT

A heat treatment system includes heating chambers configured to perform heat treatment on objects to be treated, and a conveyance device configured to load each of the objects to be treated into the heating chambers, unload the object to be treated from the heating chambers, and convey the object to be treated under an oxygen-free atmosphere, wherein the conveyance device includes a cooling device configured to perform cooling treatment on the object to be treated.

2 Claims, 8 Drawing Sheets

(51) Int. Cl.

| | |
|---|---|
| ***C23C 8/20*** | (2006.01) |
| ***F27B 17/00*** | (2006.01) |
| ***F27D 9/00*** | (2006.01) |
| ***F27B 5/12*** | (2006.01) |
| ***F27D 99/00*** | (2010.01) |
| ***C21D 9/00*** | (2006.01) |
| ***F27D 3/00*** | (2006.01) |
| ***F27B 5/02*** | (2006.01) |
| ***F27B 5/13*** | (2006.01) |
| ***F27D 15/02*** | (2006.01) |
| ***F27B 9/02*** | (2006.01) |
| ***F27B 9/04*** | (2006.01) |
| ***F27B 9/24*** | (2006.01) |
| *C21D 1/06* | (2006.01) |

(52) U.S. Cl.

CPC ..... *F27B 5/02* (2013.01); *F27B 5/12* (2013.01); *F27B 5/13* (2013.01); *F27B 9/028* (2013.01); *F27B 9/042* (2013.01); *F27B 9/2407* (2013.01); *F27B 17/0016* (2013.01); *F27D 3/0024* (2013.01); *F27D 7/00* (2013.01); *F27D 9/00* (2013.01); *F27D 15/0206* (2013.01); *F27D 99/0073* (2013.01); *C21D 1/06* (2013.01); *F27B 2009/122* (2013.01); *F27B 2009/126* (2013.01)

(56) References Cited

U.S. PATENT DOCUMENTS

| | | | | |
|---|---|---|---|---|
| 8,617,461 | B2 | 12/2013 | Yamada et al. | |
| 2013/0019796 | A1 | 1/2013 | Yamada et al. | |
| 2013/0175741 | A1* | 7/2013 | Hamid ..... | C21D 9/0018 266/44 |
| 2016/0053359 | A1* | 2/2016 | Heuer ..... | C21D 1/06 148/218 |

FOREIGN PATENT DOCUMENTS

| | | | | |
|---|---|---|---|---|
| JP | 3-130317 | A | | 6/1991 |
| JP | 6-174377 | A | | 6/1994 |
| JP | 6-287630 | A | | 10/1994 |
| JP | 8-178535 | A | | 7/1996 |
| JP | 2006-63363 | A | | 3/2006 |
| JP | 2007-315729 | A | | 12/2007 |
| JP | 2007315729 | A | * | 12/2007 |
| JP | 2008-170116 | A | | 7/2008 |
| JP | 2008170116 | A | * | 7/2008 |
| JP | 2009-236344 | A | | 10/2009 |
| JP | 2009236344 | A | * | 10/2009 |
| JP | 2011-21850 | A | | 2/2011 |
| JP | 2014-51695 | A | | 3/2014 |
| JP | 2015-17790 | A | | 1/2015 |
| JP | 5669981 | B1 | | 2/2015 |
| JP | 2016-89251 | A | | 5/2016 |

* cited by examiner

HEAT TREATMENT SYSTEM

CROSS-REFERENCE TO RELATED APPLICATIONS

This application is a continuation application based on a PCT Patent Application No. PCT/JP2016/058951, filed Mar. 22, 2016, whose priority is claimed on Japanese Patent Application No. 2015-067959, filed on Mar. 30, 2015. The contents of both the PCT Application and the Japanese Application are incorporated herein by reference.

TECHNICAL FIELD

The present disclosure relates to a heat treatment system.

BACKGROUND ART

Patent Document 1 discloses a multi-chamber heat treatment device including an intermediate conveyance chamber, heating chambers, and a cooling chamber. In the multi-chamber heat treatment device, an object to be treated (a metal part) which has been subjected to heat treatment in one of the heating chambers is conveyed to the cooling chamber via the intermediate conveyance chamber and is subject to cooling treatment therein. In the multi-chamber heat treatment device, a constitution in which three heating chambers are provided with respect to one cooling chamber is adopted in consideration of a time required for heat treatment is shorter than a time required for cooling treatment. In other words, in the multi-chamber heat treatment device, the number of heating chambers is set to be larger than the number of cooling chambers so that operating efficiency of the cooling chamber is increased and thus overall heat treatment efficiency is improved.

Note that, as a heat treatment device, there are a single chamber type in which heat treatment and cooling treatment is performed in a single processing chamber, a two chamber type in which one heating chamber and one cooling chamber are disposed to be adjacent to each other, a continuous type in which a plurality of heating chambers and a cooling chamber are disposed in a row, a conveyance device separate type in which a dedicated conveyance device is provided between a heating chamber and a cooling chamber, and the like in addition to the above-described multi-chamber type.

CITATION LIST

Patent Document

Patent Document 1

Japanese Unexamined Patent Application, First Publication No. 2014-051695

SUMMARY

In heat treatment performed on a metal part, management of a temperature history is significantly important, as is well known. When an actual temperature history differs from a previously scheduled temperature history, an intended function is not added to an object to be treated. Carburizing treatment is exemplified as one of the heat treatment processes, and after carbon is infiltrated (carburized) into a surface of a steel material in a heated state in the carburizing treatment, quenching treatment is performed by rapidly cooling the surface. When a temperature history of such rapid cooling differs from a previously scheduled temperature history, a desired strength cannot be imparted to the object to be treated (the steel material).

However, in the above-described multi-chamber heat treatment device, the object to be treated passes through the intermediate conveyance chamber when the object to be treated is conveyed from the heating chamber to the cooling chamber. For this reason, it is difficult to manage the temperature history when the object to be treated is cooled in the cooling chamber and thus the temperature history cannot be managed accurately.

The present disclosure was made in view of the above-described circumstances, and an object of the present disclosure is to manage the temperature history, when cooling treatment is performed on the object to be treated, more accurately than in the related art, in performing heat treatment on the object to be treated.

In order to accomplish the objectives, a heat treatment system according to a first aspect of the present disclosure includes: a heating chamber configured to perform heat treatment on an object to be treated; and a conveyance device configured to load the object to be treated into the heating chamber, unload the object to be treated from the heating chamber, and convey the object to be treated under an oxygen-free atmosphere, wherein the conveyance device includes a cooling device configured to perform cooling treatment on the object to be treated.

According to the present disclosure, since a conveyance device includes a cooling device configured to perform cooling treatment on object to be treated, a temperature history when cooling treatment is performed on the object to be treated can be managed more accurately than in the related art.

DESCRIPTION OF EMBODIMENTS

Hereinafter, an embodiment of the present disclosure will be described with reference to the drawings.

A heat treatment system according to this embodiment is a facility configured to perform predetermined heat treatment on objects to be treated X (workpieces) using the cooperation of a plurality of devices. The objects to be treated X are each various parts (metal parts) made of a metallic material and are moved between the devices while the objects to be treated X are stowed in a predetermined conveying container. The heat treatment system performs well-known carburizing treatment as heat treatment for metal parts on such objects to be treated X.

Figure 1:
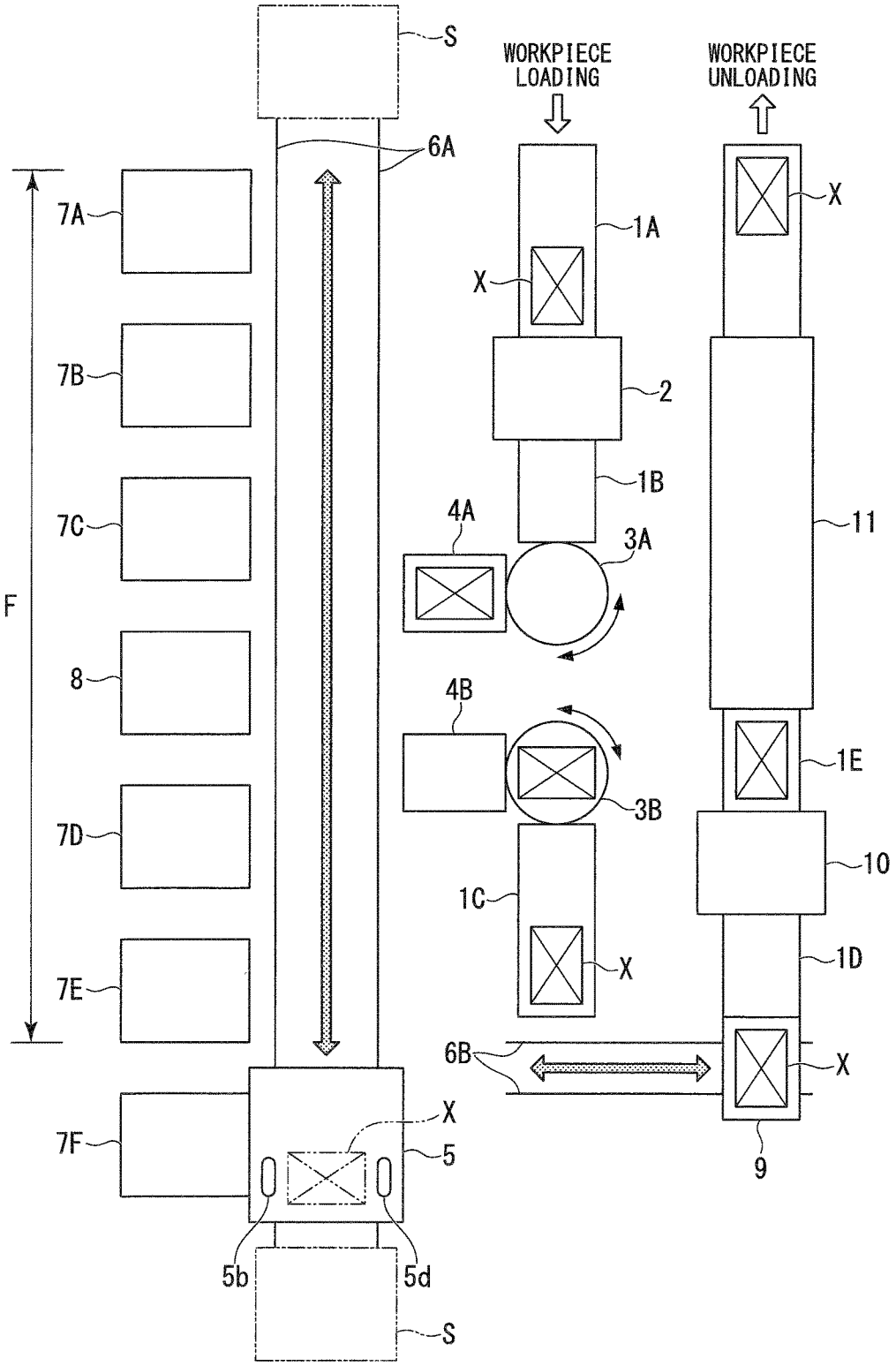
FIG. 1 is a schematic diagram showing a main part constitution of a heat treatment system according to an embodiment of the present disclosure.

As shown in FIG. 1, the heat treatment system includes five roller conveyors 1A to 1E, a pre-washing machine 2, a pair of turntables 3A and 3B, a pair of delivery devices 4A and 4B, a cooling and conveying device 5, two pairs of conveying rails 6A and 6B, a plurality of (six) carburizing furnaces 7A to 7F (heating chambers), a gas cooling furnace 8 (a gas cooling chamber), a transfer device 9, a post-washing machine 10, and a continuous tempering furnace 11.

The five roller conveyors 1A to 1E are conveyance devices configured to convey each of the objects to be treated X between the devices. Among the five roller conveyors 1A to 1E, the roller conveyor 1A conveys one of objects to be treated X supplied from a workpiece loading device (not shown) to the pre-washing machine 2. The roller conveyor 1B conveys the object to be treated X supplied from the pre-washing machine 2 to a turntable 3A. The roller conveyor 1C conveys the object to be treated X supplied from a turntable 3B to the transfer device 9.

The roller conveyor 1D conveys the object to be treated X supplied from the transfer device 9 to the post-washing machine 10. The roller conveyor 1E is provided to pass through the continuous tempering furnace 11 and conveys the object to be treated X supplied from the post-washing machine 10 to a workpiece unloading device (not shown) to pass the object to be treated X through the continuous tempering furnace 11.

The pre-washing machine 2 is a cleaning device configured to perform degreasing cleaning (pre-degreasing cleaning) on an object to be treated X before heat treatment under a vacuum atmosphere. An energy saving type vacuum cleaner disclosed in, for example, Japanese Unexamined Patent Application, First Publication No. 2014-166637 is adopted as the pre-washing machine 2. The turntable 3A includes a workpiece table on which the object to be treated X is placed, an electric motor configured to rotatably drive the workpiece table, and the like and the turntable 3A changes a conveyance direction of the object to be treated X supplied from the roller conveyor 1B and supplies the object to be treated X to the delivery device 4A. The turntable 3A of this embodiment changes an angle of the conveyance direction of the object to be treated X by 90 degrees as shown in the drawing and supplies the object to be treated X to the delivery device 4A.

The delivery device 4A delivers the object to be treated X supplied from the turntable 3A to the cooling and conveying device 5. The cooling and conveying device 5 is a conveyance device with an oil cooling function, which moves on conveying rails 6A. The cooling and conveying device 5 conveys the object to be treated X supplied from the delivery device 4A to any of the six carburizing furnaces 7A to 7F, performs oil cooling treatment on the object to be treated X received from the carburizing furnaces 7A to 7F, and conveys the object to be treated X to a delivery device 4B or the gas cooling furnace 8.

In the case of this embodiment, the pair of conveying rails 6A are provided along the carburizing furnaces 7A to 7F and the gas cooling furnace 8 which are arranged in a row. The cooling and conveying device 5 conveys the object to be treated X to the delivery device 4B, the carburizing furnaces 7A to 7F, or the gas cooling furnace 8 while moving on the conveying rails 6A.

Figure 2:
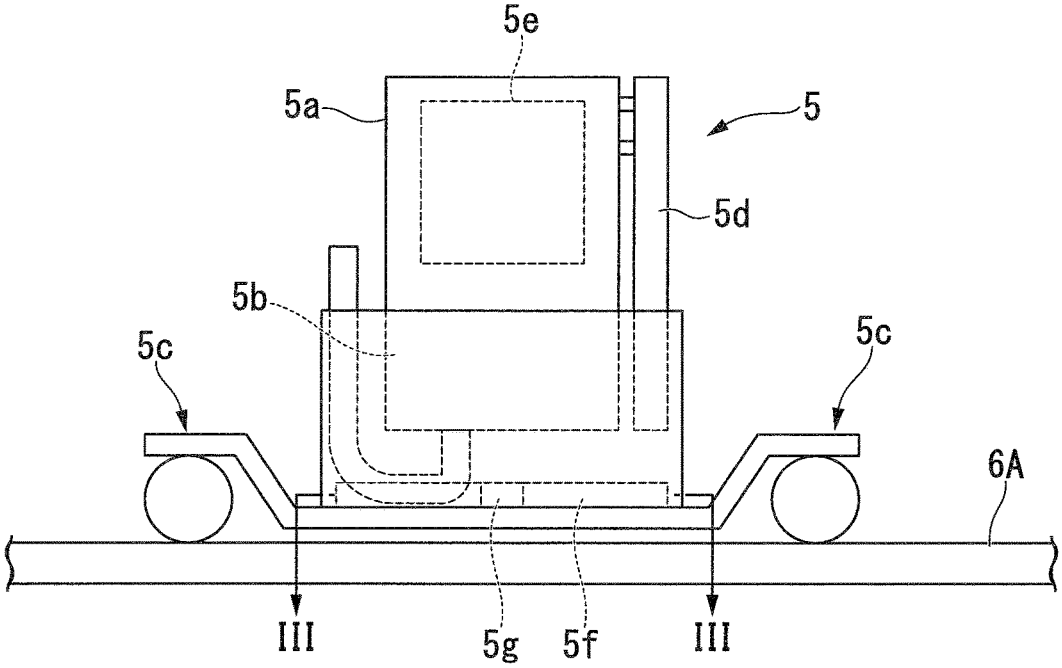
FIG. 2 is a side view showing a schematic constitution of a cooling and conveying device according to the embodiment of the present disclosure.
Figure 3:
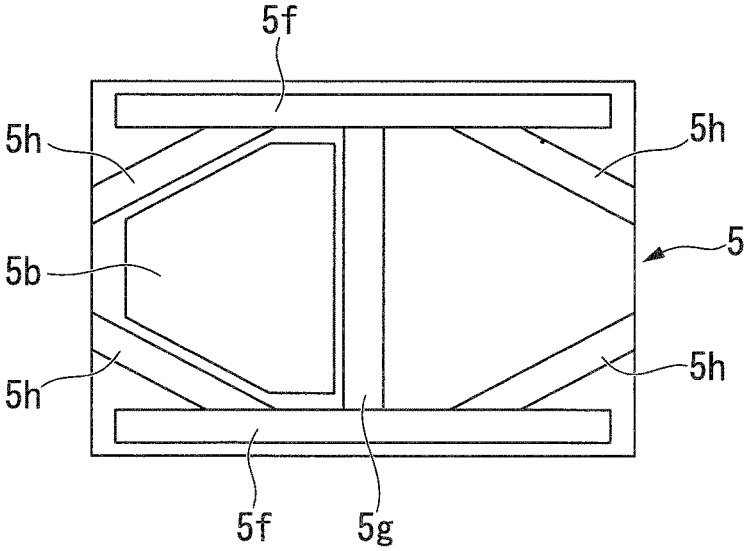
FIG. 3 is a cross-sectional view taken along line of FIG. 2.

An example of the cooling and conveying device 5 is illustrated in FIGS. 2 and 3. The cooling and conveying device 5 is constituted such that an oil cooling device 5*b* is built in a vacuum chamber 5*a* with a predetermined shape including a vacuum pump and can travel on the conveying rails 6A through a moving mechanism 5*c*. The oil cooling device 5*b* includes, for example, an oil tank configured to store predetermined cooling oil and a lifting mechanism configured to move the object to be treated X up and down. In addition, the oil cooling device 5*b* moves the object to be treated X transferred from the carburizing furnaces 7A to 7F down using a lifting mechanism, immerses the object to be treated X in the cooling oil of the oil tank, moves the object to be treated X up after a predetermined cooling period, and thus cools the object to be treated X using oil to have a desired temperature history.

Also, the cooling and conveying device 5 includes a gas cooling device 5*d* in addition to the oil cooling device 5*b*. In the gas cooling device 5*d*, an inside of the vacuum chamber 5*a* is set to an inert gas atmosphere (for example, a nitrogen gas atmosphere) and cools (performs convection cooling on) the object to be treated X by convecting an inert gas using a fan or the like.

The cooling and conveying device 5 includes a transfer mechanism (not shown) configured to transfer the object to be treated X among the carburizing furnaces 7A to 7F and the gas cooling furnace 8. The transfer mechanism transfers the object to be treated X stowed inside the cooling and conveying device 5 to the carburizing furnaces 7A to 7F or the gas cooling furnace 8 via a door 5*e* provided in the cooling and conveying device 5 and transfers the object to be treated X inside the carburizing furnaces 7A to 7F or the gas cooling furnace 8 to an inside of the cooling and conveying device 5. Note that the vacuum pump sets the inside of the vacuum chamber 5*a* to a vacuum atmosphere.

As described above, the cooling and conveying device 5 of this embodiment conveys and cools the object to be treated X under an inert gas atmosphere or a vacuum atmosphere and includes specific facilities for this purpose (the vacuum chamber 5*a*, the gas cooling device 5*d*, and the like). As a result, according to the cooling and conveying device 5 of this embodiment, the object to be treated X being conveyed is under an oxygen-free atmosphere and oxidation of the object to be treated X can be prevented. This is an important factor in obtaining an object to be treated X in which no defect such as coloring is formed on a surface thereof in the case of performing treatment such as so-called brightening treatment on the object to be treated X. Note that the expression "under an oxygen-free atmosphere" in the present disclosure includes when there is no oxygen such as under a nitrogen gas atmosphere, under an inert gas atmosphere, and under a vacuum atmosphere as well as an oxygen deficiency state in which the object to be treated X is less oxidized than a state in which the object to be treated X has been exposed to the atmosphere. An oxygen concentration in the above "under an oxygen-free atmosphere" is normally 0.1% by volume or less (for example, 0 to 0.1% by volume).

Also, the moving mechanism 5*c* is constituted of driving wheels disposed above the conveying rails 6A and a driving mechanism configured to rotatably drive the driving wheels, and the like.

From operational reasons, a floor of the cooling and conveying device 5 should be set as low as possible. Therefore, in the cooling and conveying device 5 of this embodiment, ribs 5*f*, 5*g*, and 5*h* configured to reinforce a floor of the cooling and conveying device 5 are provided at an inner side of the cooling and conveying device 5. To be specific, the ribs 5*f* to 5*h* are provided to protrude above the floor. Thus, interference between the ribs 5*f* to 5*h* and a rail 6A or the like is prevented, a distance between the floor and the rail 6A is reduced, and thus the floor of the cooling and conveying device 5 is lowered.

On the other hand, when the ribs 5*f* to 5*h* are provided at the inner side of the cooling and conveying device 5, there is a concern about the ribs 5*f* to 5*h* protruding about the floor interfering with, for example, a part (a device configured to cool and stir cooling oil inside the oil tank) of the oil cooling device 5*b* or the like. Thus, in the cooling and conveying device 5 of this embodiment, for example, as shown in FIG. 3, the ribs 5*f* to 5*h* are provided at positions which do not interfere with facilities such as the oil cooling device 5*b* and the like installed at the bottom of the cooling and conveying device 5 so that interference between the facilities and the ribs 5*f* to 5*h* and a resulting increase in the overall height of the cooling and conveying device 5 are prevented. To be specific, the ribs 5*f* to 5*h* are disposed at positions which the ribs and the facilities do not overlap vertically but overlap forward and rearward and/or leftward and rightward so that interference between the facilities and the ribs 5*f* to 5*h* in a vertical direction is prevented.

Also, when the object to be treated X is transferred between the cooling and conveying device 5 and the carburizing furnaces 7A to 7F and the gas cooling furnace 8, in order to minimize a change in temperature around the object to be treated X due to the transferring, oxidation of the object to be treated X due to contact with the atmosphere, and the like, the object to be treated X is transferred in a state in which the cooling and conveying device 5 comes in close contact with the carburizing furnaces 7A to 7F or the gas cooling furnace 8 as much as possible. As a constitution for this purpose, the cooling and conveying device 5, the carburizing furnaces 7A to 7F, and the gas cooling furnace 8 of this embodiment are constituted, for example, as shown in FIG. 4.

Figure 4:
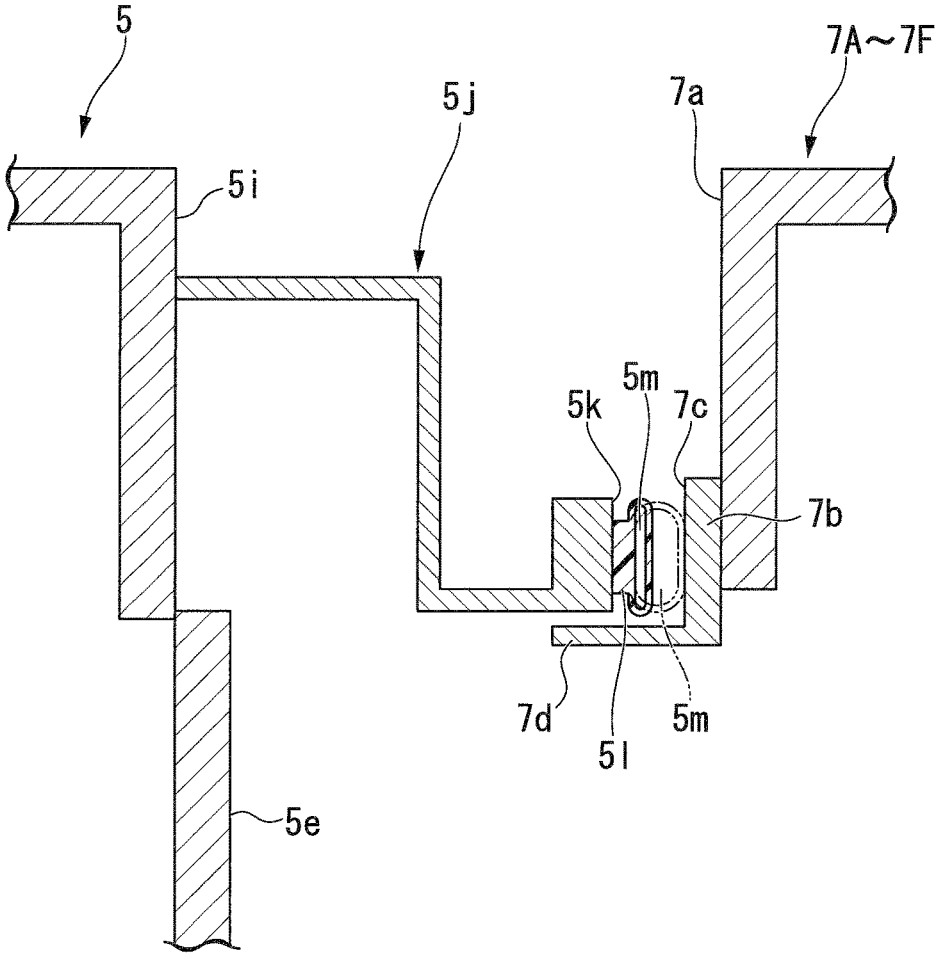
FIG. 4 is a cross-sectional view showing a constitution of a connecting part between a cooling and conveying device and a carburizing furnace according to the embodiment of the present disclosure.

FIG. 4 is a cross-sectional view showing a constitution of a connecting part between the cooling and conveying device 5 and the carburizing furnace 7A to 7F. A frame-like cover 5*j* surrounding a periphery of the door 5*e* is attached to an outer wall 5*i* of the cooling and conveying device 5 which faces the carburizing furnace 7A to 7F (that is, a side at which the door 5*e* is formed). The cover 5*j* has a surface protruding toward the carburizing furnaces 7A to 7F, bent inward, and being parallel to the outer wall 5*i*, protruding toward the carburizing furnaces 7A to 7F, and bent outward. As a result, an end surface 5*k* which is parallel to the outer wall 5*i* and facing the carburizing furnace 7A to 7F is formed at a distal end of the cover 5*j*.

A seal part 5*l* constituted of a flexible member is disposed above the end surface 5*k* to surround the periphery of the door 5*e*. The seal part 5*l* has a tubular cross section and uniformly expands toward the carburizing furnaces 7A to 7F when, for example, a fluid such as air is supplied to an internal space 5*m* thereof. Furthermore, for example, a heat resistant resin such as a fluororesin, a silicon resin, or the like, nitrile rubber, or the like is used as a material of the seal part 5*l*.

On the other hand, a frame-like cover 7*b* surrounding a periphery of a door (which will be described below) of the carburizing furnace 7A to 7F is attached to an outer wall 7*a* of the carburizing furnace 7A to 7F which faces the cooling and conveying device 5. The cover 7*b* has a protective plate 7*d* with an end surface 7*c* parallel to the outer wall 7*a*, bent toward the cooling and conveying device 5, and protruding toward the cooling and conveying device 5. Furthermore, the end surface 7*c* and the protective plate 7*d* are located such that the end surface 7*c* faces a distal end surface of the seal part 5*l* and the protective plate 7*d* covers the seal part 5*l* from an inside when the cooling and conveying device 5 is connected to the carburizing furnaces 7A to 7F to transfer each of the objects to be treated X from the cooling and conveying device 5 to the carburizing furnaces 7A to 7F. Note that, although not illustrated in the drawings, a cover with the same constitution as the cover 7*b* is also attached to an outer wall of the gas cooling furnace 8 which faces the cooling and conveying device 5.

The six carburizing furnaces 7A to 7F provide heating chambers configured to perform heat treatment and carburizing treatment on the objects to be treated X. Each of the carburizing furnaces 7A to 7F includes a vacuum chamber, a vacuum pump, a mechanical booster pump, a heating device, a carburizing gas supply device, and the like, the vacuum chamber thereof stows the object to be treated X is set to a predetermined vacuum atmosphere (a degree of vacuum) using a vacuum pump and the vacuum chamber is set to a predetermined high temperature state using a heating device. In addition, a carburizing gas such as acetylene is supplied from the carburizing gas supply device into the vacuum chamber in this state and thus carbon is injected (carburized) into a surface of the object to be treated X.

Figure 5:
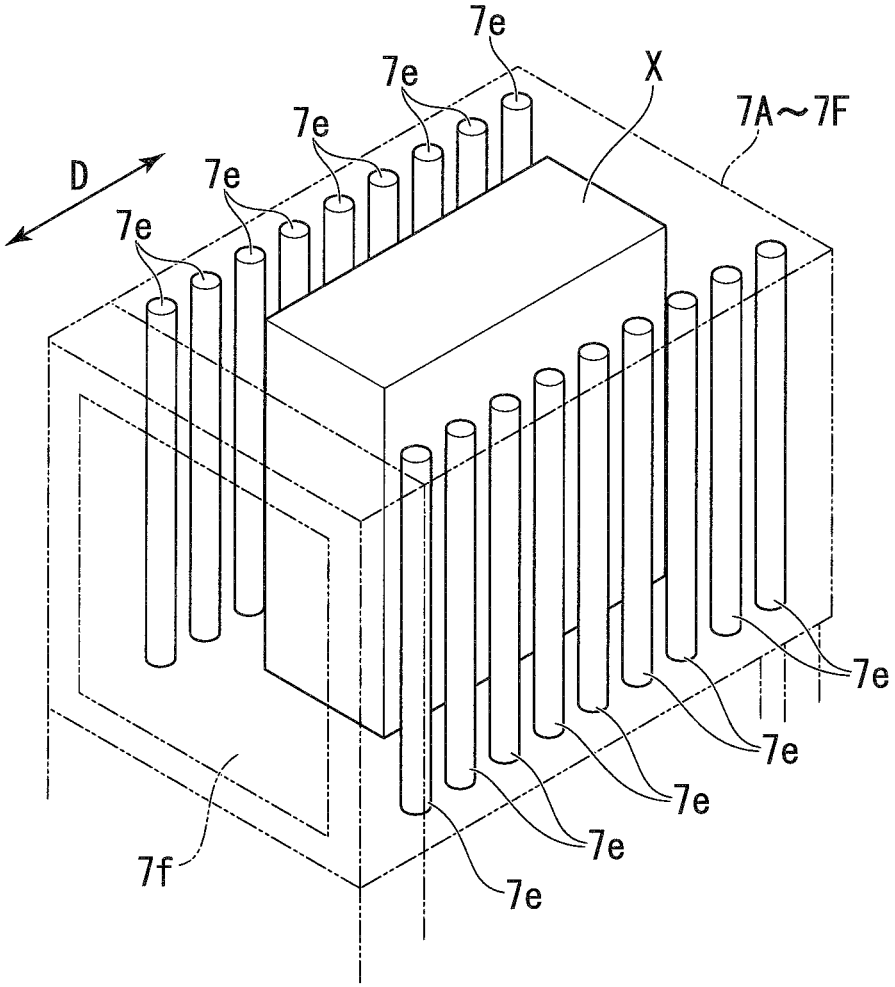
FIG. 5 is a perspective view showing a schematic constitution of the carburizing furnace according to the embodiment of the present disclosure.

Also, for example, as shown in FIG. 5, each of the carburizing furnaces 7A to 7F of this embodiment is constituted such that a plurality of heating devices 7*e* are vertically arranged at both sides inside each of the carburizing furnaces 7A to 7F in a loading/unloading direction D of the object to be treated X. Furthermore, a reference numeral 7*f* in FIG. 5 is a door configured to loading/unload the object to be treated X between the carburizing furnace and the cooling and conveying device 5.

Each of the carburizing furnaces 7A to 7F includes the vacuum pump as well as the mechanical booster pump. The mechanical booster pump is a pump configured to assist the vacuum pump and increases an exhaust rate when a pressure of the vacuum chamber has been lowered to some extent. Such a mechanical booster pump is provided in each of the six carburizing furnaces 7A to 7F so that the pressure of the vacuum chamber of each of the carburizing furnaces 7A to 7F can be reduced up to a desired degree of vacuum (for example, 500 Pa or less) at a higher rate than that of the case in which the mechanical booster pump is not provided. Note that, when acetylene is used as the carburizing gas, a degree of vacuum inside the vacuum chamber in each of the carburizing furnaces 7A to 7F is set to, for example, 200 to 300 Pa.

The gas cooling furnace 8 provides a gas cooling chamber configured to perform gas cooling treatment on the object to be treated X. The gas cooling furnace 8 includes a vacuum chamber, a vacuum pump, a cooling gas supply device, a circulating device, and the like and the vacuum chamber stows the object to be treated X is set to a predetermined vacuum atmosphere using a vacuum pump. In addition, a cooling gas such as nitrogen gas is supplied from the cooling gas supply device into the vacuum chamber in this state, the cooling gas is circulated inside the vacuum chamber, and thus the object to be treated X is cooled to have a desired temperature history.

Here, the six carburizing furnaces 7A to 7F are arranged in a row while the gas cooling furnace 8 is interposed therebetween as shown in the drawing. In other words, three carburizing furnaces 7A to 7C are arranged in a row while being adjacent to each other and the remaining three carburizing furnaces 7D to 7F are similarly arranged in a row while being adjacent to each other. In addition, the gas cooling furnace 8 is positioned between the carburizing furnace 7C and the carburizing furnace 7D. In other words, in the heat treatment system, the gas cooling furnace 8 is positioned in the middle of the six carburizing furnaces 7A to 7F.

The delivery device 4B is a device configured to deliver the object to be treated X received from the cooling and conveying device 5 to the turntable 3B. The turntable 3B includes a workpiece table on which the object to be treated X is placed, an electric motor configured to rotatably drive the workpiece table, and the like, changes a conveyance direction of the object to be treated X supplied from the delivery device 4B, and supplies the object to be treated X to the roller conveyor 1C. The turntable 3B of this embodiment changes an angle in the conveyance direction of the object to be treated X by 90 degrees and supplies the object to be treated X to the roller conveyor 1C as in the turntable 3A described above.

The transfer device 9 is a device configured to transfer the object to be treated X supplied from the roller conveyor 1C to the roller conveyor 1D extending in the same direction as the roller conveyor 1C. The transfer device 9 moves along the pair of conveying rails 6B to transfer the object to be treated X from the roller conveyor 1C to the roller conveyor 1D. The pair of conveying rails 6B are provided to extend in a direction orthogonal to the pair of conveying rails 6A described above. In other words, the transfer device 9 moves in a direction orthogonal to a moving direction of the cooling and conveying device 5.

Here, in the heat treatment system, the carburizing furnaces 7A to 7F and the gas cooling furnace 8 are disposed in a row as shown in the drawing and the conveying rails 6A are laid along the carburizing furnaces 7A to 7F and the gas cooling furnace 8 such that a layout thereof is set to linearly move the cooling and conveying device 5. As shown in the drawing, devices other than the conveying rails 6A, the carburizing furnaces 7A to 7F, the gas cooling furnace 8, and the cooling and conveying device 5, are disposed in two rows in such a basic layout relationship in an arrangement direction of the carburizing furnaces 7A to 7F and the gas cooling furnace 8, that is, in a direction which is the same as a direction along which the conveying rails 6A extend at a side opposite to the carburizing furnaces 7A to 7F and the gas cooling furnace 8 with regard to the conveying rails 6A.

The post-washing machine 10 is a device configured to perform degreasing cleaning (post-degreasing cleaning) on the object to be treated X which has undergone heat treatment under a vacuum atmosphere. In other words, the post-washing machine 10 performs the post-degreasing cleaning process on the object to be treated X which has been subjected to carburizing treatment through the carburizing furnaces 7A to 7F and the cooling and conveying device 5, or the carburizing furnaces 7A to 7F, the cooling and conveying device 5, and the gas cooling furnace 8. Note that, for example, the energy saving type vacuum cleaner disclosed in Japanese Unexamined Patent Application, First Publication No. 2014-166637 is adopted as the post-washing machine 10 as with the above-described pre-washing machine 2.

The continuous tempering furnace 11 is a device obtained by continuously installing a plurality of tempering furnaces in a row and performs tempering treatment on the object to be treated X which has been subjected to the post-degreasing cleaning process. In other words, the continuous tempering furnace 11 reheats the object to be treated X which has been subjected to the carburizing treatment using the carburizing furnaces 7A to 7F, the gas cooling furnace 8, and the cooling and conveying device 5, so as to stabilize a metal structure of the object to be treated X (the metal part).

Note that, although not illustrated in the drawings, the operations of the devices constituting the above-described heat treatment system are comprehensively controlled by a predetermined control device. The control device includes software configured to control the devices based on a predetermined control program and realizes a unified operation of the heat treatment system.

Next, the operation of the heat treatment system constituted in this way will be described in detail with reference to FIGS. 2 to 4 as well.

Objects to be treated X supplied from an outside to the heat treatment system are first conveyed to the pre-washing machine 2 using the roller conveyor 1A and are subject to a pre-degreasing cleaning process in the pre-washing machine 2. Then, each of the objects to be treated X after the pre-degreasing cleaning process is conveyed in the order of the roller conveyor 1B, the turntable 3A, and the delivery device 4A, and is supplied to the cooling and conveying device 5.

The object to be treated X, after the pre-degreasing cleaning process, is supplied to the cooling and conveying device 5, and is conveyed to any of carburizing furnaces being on standby, for example, the carburizing furnace 7A through the cooling and conveying device 5. In other words, the cooling and conveying device 5 travels on the conveying rails 6A to the delivery device 4A and receives the object to be treated X, and further travels to the carburizing furnace 7A and stows the object to be treated X inside the carburizing furnace 7A.

Also, the cooling and conveying device 5 collects the object to be treated X from the carburizing furnace 7A when the process has been performed on the object to be treated X inside the carburizing furnace 7A, stows the object to be treated X inside its own chamber and cools the object to be treated X, moves the object to be treated X from the carburizing furnace 7A to the delivery device 4B, and delivers the object to be treated X.

Here, when the object to be treated X is moved between the cooling and conveying device 5 and the carburizing furnace 7A, as shown in FIG. 4, the cooling and conveying device 5 is relatively moved to the carburizing furnace 7A such that the protective plate 7*d* of the carburizing furnace 7A is inserted into the cover 5*j* of the cooling and conveying device 5. Also, the distal end surface of the seal part 5*l* faces the end surface 7*c* and the seal part 5*l* is covered by the protective plate 7*d* from an inside. When a fluid such as, for example, air is supplied to the internal space 5*m* of the seal part 5*l* in this state, the seal part 5*l* uniformly expands toward the carburizing furnace 7A. As a result, as indicated by an alternate long and two short dashed line in FIG. 4, the distal end surface of the seal part 5*l* comes in close contact with the end surface 7*c* and air tightness is secured between the cooling and conveying device 5 and the carburizing furnace 7A. Thus, the object to be treated X can be transferred between the cooling and conveying device 5 and the carburizing furnace 7A while oxidation or the like of the object to be treated X caused by a change in temperature around the object to be treated X or contact with the atmosphere is minimized.

When the transfer of the object to be treated X between the cooling and conveying device 5 and the carburizing furnace 7A is completed, the supply of the fluid to the internal space 5*m* is stopped and the seal part 5*l* is contracted. After that, the cooling and conveying device 5 is relatively moved to the carburizing furnace 7A so that the protective plate 7*d* inserted into the cover 5*j* is separated from the cover 5*j*. Thus, contact between the cooling and conveying device 5 and the carburizing furnace 7A is released.

In this case, a heat resistant resin is used for a material of the seal part 5*l* so that deterioration of the seal part 5*l* caused by heat is small even when the distal end surface of the seal part 5*l* is brought in close contact with the relatively hot end surface 7*c* of the carburizing furnace 7A. Furthermore, since the seal part 5*l* is attached to the cooling and conveying device 5 with a relatively lower temperature, the seal part 5*l* is hardly affected by heat and a change of the seal part 5*l* over time is small. When the cooling and conveying device 5 is brought into contact with the carburizing furnace 7A, the seal part 5*l* is protected by the protective plate 7*d* from the inside such that the protective plate 7*d* covers the seal part 5*l* from the inside and an influence on the seal part 5*l* due to heat, oil, or the like from the carburizing furnace 7A or the like decreases. When the distal end surface of the seal part 5*l* is in contact with the end surface 7*c* even when there is some deviation in distance among the facing end surfaces 5*k* and 7*c* and relative positions in vertical and horizontal directions, air tightness is secured between the cooling and conveying device 5 and the carburizing furnace 7A. For this reason, when the cooling and conveying device 5 comes into contact with the carburizing furnaces 7A to 7F, positioning accuracy among them is relatively low.

The object to be treated X is conveyed to the post-washing machine 10 via the delivery device 4B, the turntable 3B, the roller conveyor 1C, the transfer device 9, and the roller conveyor 1D in this order, and is subject to the post-degreasing cleaning process. Furthermore, the object to be treated X which has been subjected to the post-degreasing cleaning process undergoes tempering treatment in the continuous tempering furnace 11 while being conveyed through the roller conveyor 1E and is discharged to the outside.

Figure 6:
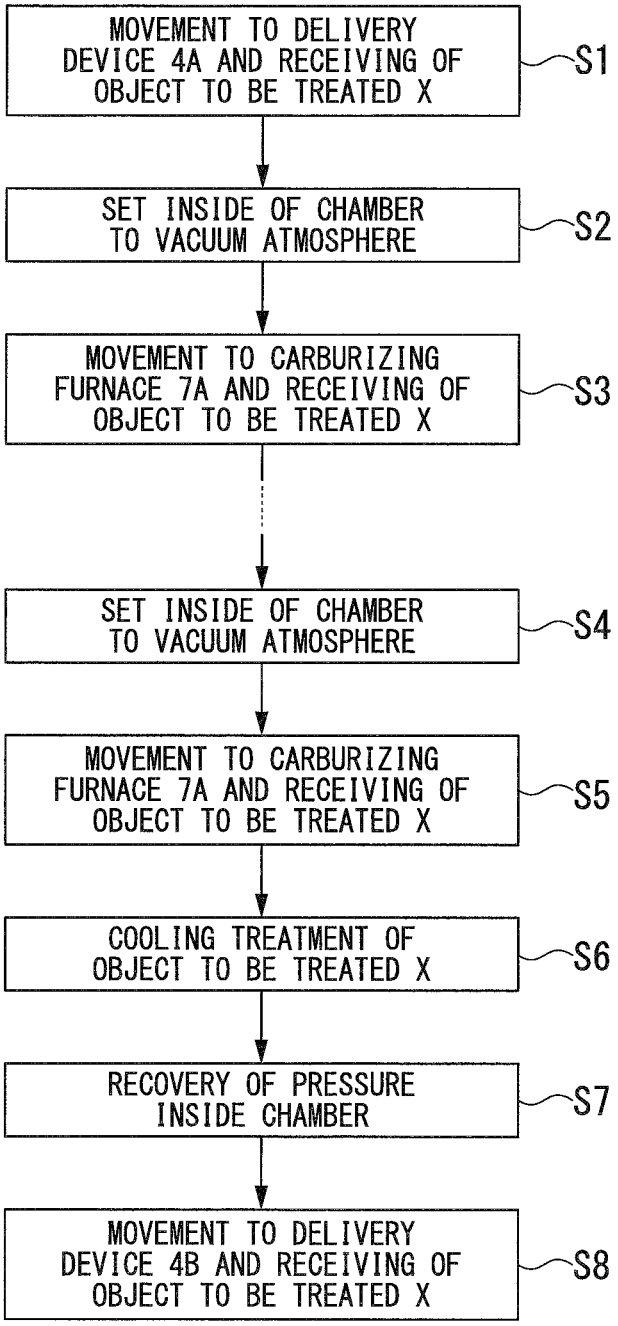
FIG. 6 is a flowchart for describing an operation of a cooling and conveying device in the embodiment of the present disclosure.

Although the overall operation of the heat treatment system has been described above, the cooling and conveying device 5 operates as illustrated in a flowchart of FIG. 6 among the series of operations of such a heat treatment system.

In other words, the cooling and conveying device 5 moves to the delivery device 4A by operating a moving mechanism and receives the object to be treated X (Step S1) when receiving an instruction to convey the object to be treated X to the carburizing furnace 7A from the above-described control device. Furthermore, the cooling and conveying device 5 sets the inside of its own chamber to a predetermined vacuum atmosphere by operating the vacuum pump (Step S2), moves to the carburizing furnace 7A by operating the moving mechanism, and transfers the object to be treated X from its own chamber into the chamber of the carburizing furnace 7A by operating the transfer mechanism (Step S3).

Figure 7:
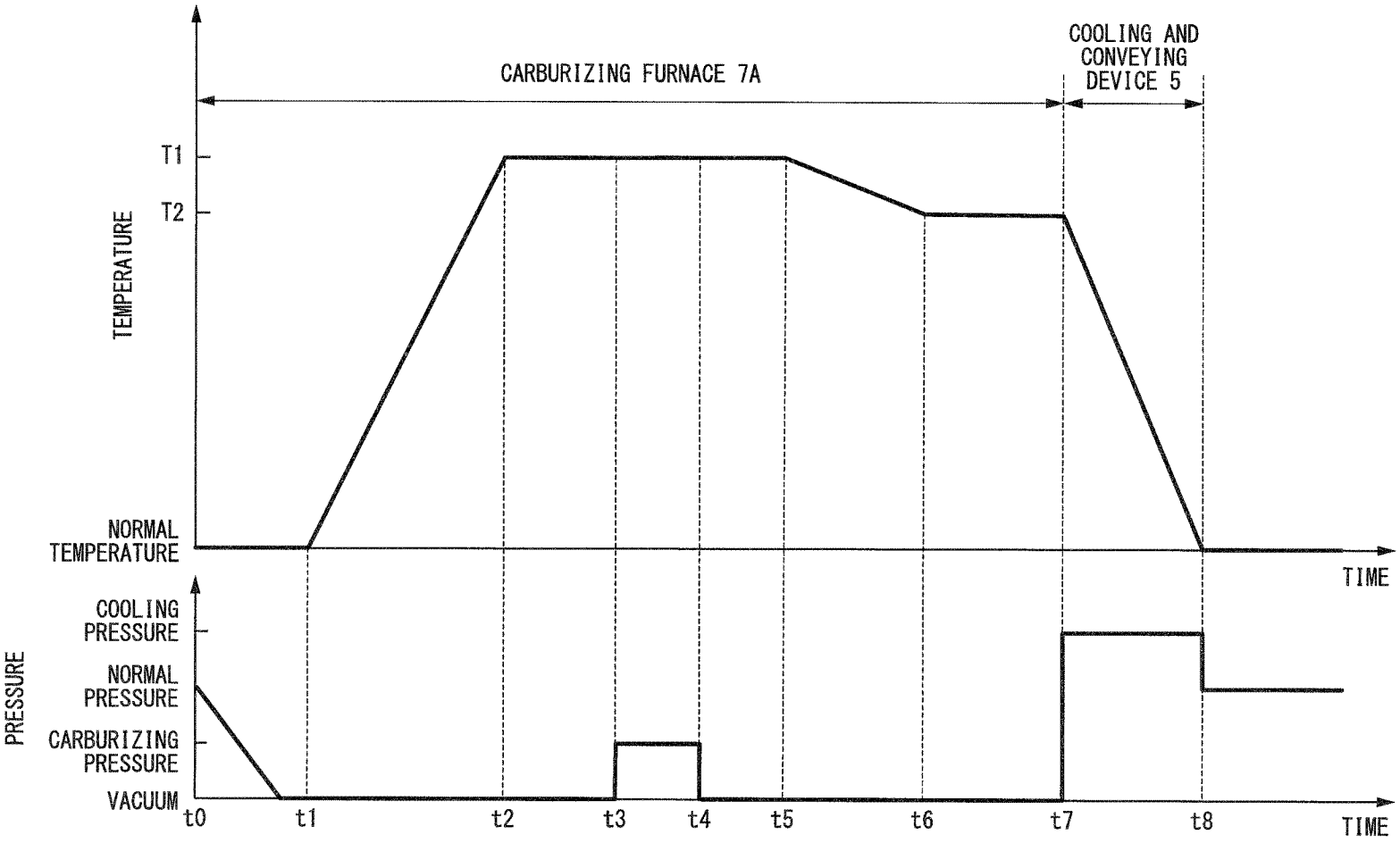
FIG. 7 is a first graph illustrating a temperature history and a pressure history of a heat treatment step in the embodiment of the present disclosure.

When the carburizing furnace 7A stows the object to be treated X as described above, the decompression of the chamber of the carburizing furnace 7A is started at time t0 and the chamber is set to a predetermined vacuum atmosphere as shown in FIG. 7. In addition, the heating of the chamber is started from time t1 and the chamber is heated to a desired carburization temperature T1 at time t2. After that, the carburization temperature T1 of the carburizing furnace 7A is maintained to time t5 and a carburizing gas is supplied into the chamber during a period from time t3 to t4 (a carburization period) so that carburizing treatment is performed on the object to be treated X. Note that a period from time t2 to t3 before the above-described carburization period is a soaking period and a subsequent period from time t4 to t5 is a diffusion period. In the carburizing furnace 7A, when the diffusion period has been completed, the operation of the heating device 7*e* is stopped so that the carburization temperature T1 is relatively gradually lowered to a temperature T2 and the temperature T2 is maintained from time t6 to t7.

In the carburizing furnace 7A, the heat treatment and the carburizing treatment are performed on the object to be treated X in a period from time t0 to t7 as described above. When the heat treatment and the carburizing treatment have been finished, the object to be treated X is transferred from the carburizing furnace 7A to the cooling and conveying device 5 and is subject to rapid cooling treatment. In other words, when receiving an instruction from the above-described control device to collect the object to be treated X from the carburizing furnace 7A, the chamber of the cooling and conveying device 5 is set to a predetermined vacuum atmosphere by operating the vacuum pump (Step S4), and the cooling and conveying device 5 is moved to the carburizing furnace 7A by operating the moving mechanism and receives the object to be treated X (Step S5).

Also, the cooling and conveying device 5 performs rapid cooling on the object to be treated X by operating the oil cooling device 5*b* (Step S6). In other words, the cooling and conveying device 5 quickly immerses the object to be treated X received from the carburizing furnace 7A using the transfer mechanism in cooling oil inside the oil tank by operating the lifting mechanism to perform rapid cooling on the object to be treated X. A period from t7 to t8 in FIG. 7 is a rapid cooling period using the cooling and conveying device 5.

Figure 8:
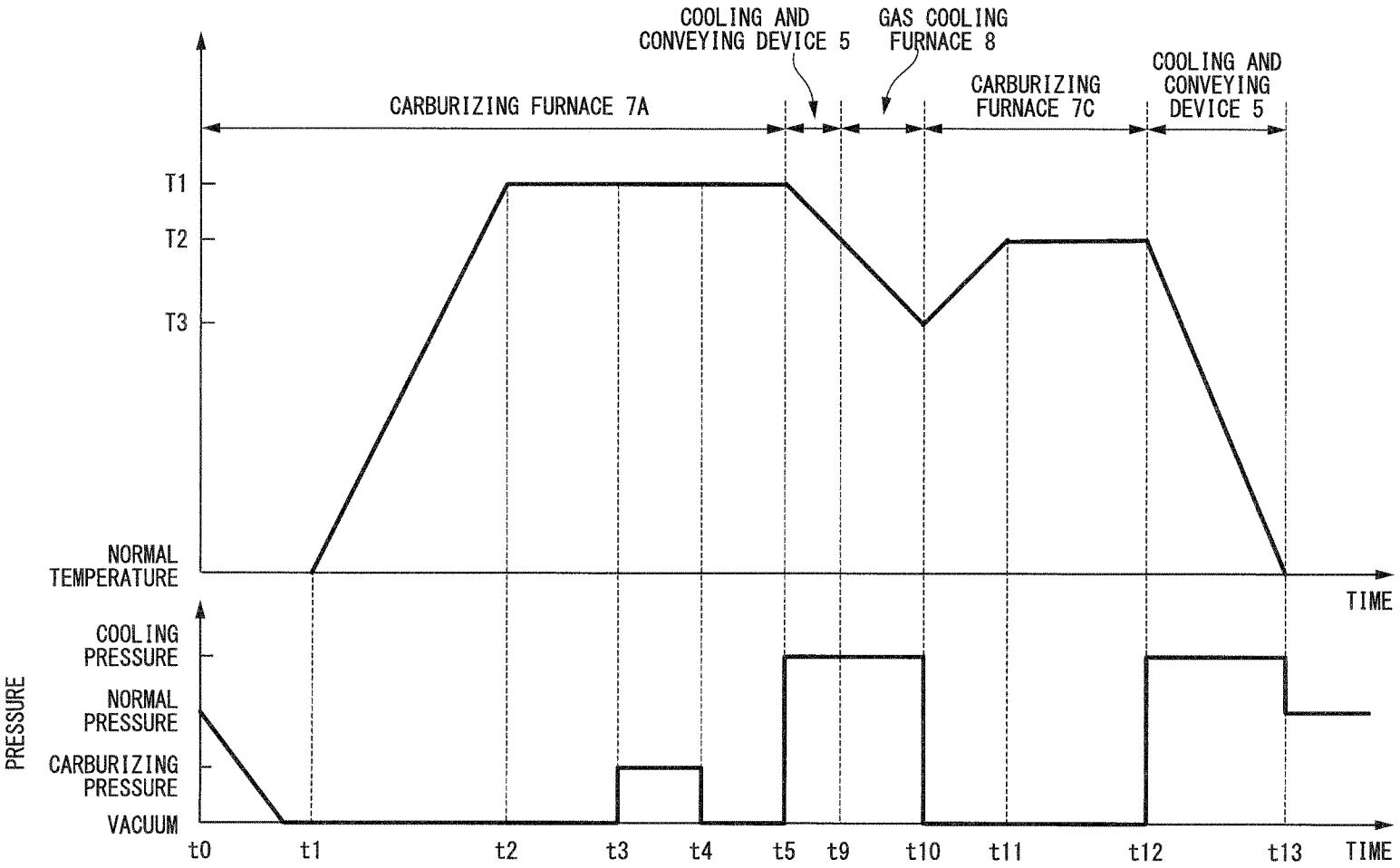
FIG. 8 is a second graph illustrating a temperature history and a pressure history of a heat treatment step in the embodiment of the present disclosure.

Here, a temperature history when the carburizing treatment is performed on the object to be treated X includes the case in which the object to be treated X is heated to the temperature T2 after the object to be treated X is relatively gradually cooled from the carburization temperature T1 to T3 as shown in FIG. 8 in addition to the case shown in FIG. 7. When the carburizing treatment is performed on the object to be treated X using such temperature history, the object to be treated X is moved from the carburizing furnace 7A to the cooling and conveying device 5 in a stage in which the diffusion period from time t4 to t5 has ended and the object to be treated X is relatively gradually cooled by operating the gas cooling device 5*d* of the cooling and conveying device 5 during a period from time t5 to t9 (a pre gas cooling period). After that, the object to be treated X is moved from the cooling and conveying device 5 to the gas cooling furnace 8 and is further subject to gas cooling during a period from time t9 to t10 (a post gas cooling period).

Here, the cooling and conveying device 5 performs a task of conveying each of the objects to be treated X among the pair of delivery devices 4A and 4B, the six carburizing furnaces 7A to 7F, and the gas cooling furnace 8. Thus, after the cooling and conveying device 5 conveys the object to be treated X delivered from the delivery device 4A to the carburizing furnace 7A, there is the case that the cooling and conveying device 5 conveys the object to be treated X to the other carburizing furnaces 7B to 7F, the gas cooling furnace 8, and the like.

Therefore, considering overall operating efficiency of the heat treatment system, it is not desirable to lengthen a binding time of the cooling and conveying device 5 (a time at which the inside of the cooling and conveying device 5 is occupied by the object to be treated X). In such circumstances, in the heat treatment system, the above-described post gas cooling period is not performed in the cooling and conveying device 5 and is performed in the gas cooling furnace 8 in order to shorten the binding time of the cooling and conveying device 5.

When the post gas cooling period of the gas cooling furnace 8 has finished, the object to be treated X is conveyed from the gas cooling furnace 8 to any of carburizing furnaces being on standby, for example, the carburizing furnace 7C using the cooling and conveying device 5 and stowed therein. Furthermore, the object to be treated X is reheated in the carburizing furnace 7C from time t10 to t12. In addition, when the reheating period has finished, the object to be treated X is subject to rapid cooling by the cooling and conveying device 5. In other words, the cooling and conveying device 5 performs rapid cooling treatment on the object to be treated X from time t12 to t13. In this case, it goes without saying that every time the objects to be treated X are conveyed among the carburizing furnaces 7A to 7F and the gas cooling furnace 8, air tightness among the cooling and conveying device 5 and the carburizing furnaces 7A to 7F and the gas cooling furnace 8 using the seal part 5*l* described above is secured.

According to this embodiment as described above, since the cooling and conveying device 5 includes the oil cooling device 5*b*, each of the objects to be treated X which has been subjected to the heat treatment and the carburizing treatment inside the carburizing furnace 7A is moved from the carburizing furnace 7A to the oil cooling device 5*b* of the cooling and conveying device 5 and can be quickly cooled inside the oil cooling device 5*b*. Therefore, the temperature history when the object to be treated X is subject to the rapid cooling treatment can be managed more accurately than in the related art.

Also, according to this embodiment, since the cooling and conveying device 5 includes the gas cooling device 5*d*, when each of the objects to be treated X at the carburization temperature T1 which has been subjected to the heat treatment and the carburizing treatment inside the carburizing furnace 7A has been relatively gradually cooled to the temperature T3 and then is reheated, cooling from the carburization temperature T1 to the temperature T3 can be performed in the cooling and conveying device 5. Therefore, the temperature history in such cooling can be managed with high accuracy.

According to this embodiment, the single gas cooling furnace 8 is provided with respect to the six carburizing furnaces 7A to 7F. Such a ratio of the number of carburizing furnaces 7A to 7F and the number of gas cooling furnaces 8 is obtained by considering the fact that a processing time of the carburizing furnaces 7A to 7F is significantly longer than a processing time of the gas cooling furnace 8. Furthermore, since the gas cooling furnace 8 is located in the middle of the six carburizing furnaces 7A to 7F when such a layout in which the six carburizing furnaces 7A to 7F and the single gas cooling furnace 8 are disposed in a row is adopted in this embodiment, a moving distance of the cooling and conveying device 5 is short when the object to be treated X is conveyed among the carburizing furnaces 7A to 7F and the gas cooling furnace 8. Therefore, a task of conveying the object to be treated X using the cooling and conveying device 5 can be performed efficiently.

According to this embodiment, as shown in FIG. 5, the plurality of heating devices 7*e* are vertically arranged on both sides inside the carburizing furnaces 7A to 7F in the loading/unloading direction D of each of the objects to be treated X. For this reason, at the time of exchanging, or the like of the heating devices 7*e*, the heating devices 7*e* can be pulled out upward from the carburizing furnaces 7A to 7F and can be inserted into the carburizing furnaces 7A to 7F from the top and spaces for exchange of the heating devices 7*e* need not be provided on sides of the carburizing furnaces 7A to 7F. Therefore, distances between neighboring carburizing furnaces 7A to 7F can be narrowed and a total length (F in FIG. 1) of the carburizing furnaces 7A to 7F which are arranged in a row can be shortened. As a result, when the object to be treated X is conveyed among the carburizing furnaces 7A to 7F, the moving distance of the cooling and conveying device 5 can be shortened and a size of the heat treatment system including the carburizing furnaces 7A to 7F can be reduced.

Note that the present disclosure is not limited to the above-described embodiment, and for example, the following modified examples are considered.

(1) Although a case in which each of the objects to be treated X is subject to the carburizing treatment has been described in the above-described embodiment, the present disclosure is not limited thereto. The present disclosure can also be applied to heat treatment other than carburizing treatment, for example, quenching treatment, nitrification treatment, or the like. In other words, heating chambers of the present disclosure are not limited to the carburizing furnaces 7A to 7F (carburizing chambers).

(2) Although the gas cooling furnace 8 is provided so as to perform the post gas cooling period by the gas cooling furnace 8 in the above-described embodiment, the present disclosure is not limited thereto. The cooling and conveying device 5 may be used for the post gas cooling period. Furthermore, when the object to be treated X need not be reheated, the gas cooling furnace 8 may be omitted.

(3) Although the plurality of (six) carburizing furnaces 7A to 7F are provided in the above-described embodiment, the present disclosure is not limited thereto. The number of carburizing furnaces 7A to 7F may be, for example, one instead of six. Furthermore, the disposition of the six carburizing furnaces 7A to 7F is not limited to one row. For example, carburizing furnaces 7A to 7F are disposed in two rows and a pair of conveying rails 6A are provided among the carburizing furnaces 7A to 7F disposed in two rows so that the cooling and conveying device 5 may move along the carburizing furnaces 7A to 7F which are disposed in two rows. Note that, in this case, the delivery device 4A is provided on one end side of a moving direction of the cooling and conveying device 5 and the delivery device 4B is provided on the other end side thereof.

(4) Although air tightness among the cooling and conveying device 5 and the carburizing furnaces 7A to 7F and the gas cooling furnace 8 using the seal part 5*l* is secured every time the objects to be treated X are conveyed among the carburizing furnaces 7A to 7F and the gas cooling furnace 8 in the above-described embodiment, when this manipulation is not required, the above-described manipulation or facilities for the above-described manipulation (refer to FIG. 4) can be omitted.

Furthermore, there is a case that a plurality of cooling and conveying devices 5 are used in the same heat treatment system, to perform cooling treatment using two or more types of cooling oil for example. In such a case, as shown in FIG. 1, when spaces S for retracting the cooling and conveying devices 5 are provided at both ends of the conveying rails 6A and one of the cooling and conveying devices 5 being uses is on the conveying rails 6A, the remaining cooling and conveying devices 5 not being used are retracted into the spaces S so that the plurality of cooling and conveying devices 5 can be used in the same heat treatment system without any problems. Furthermore, the spaces S can also be used as spaces for maintenance (exchange or cooling of cooling oil, and the like) of cooling and conveying devices 5 not being in use.

Figure 9:
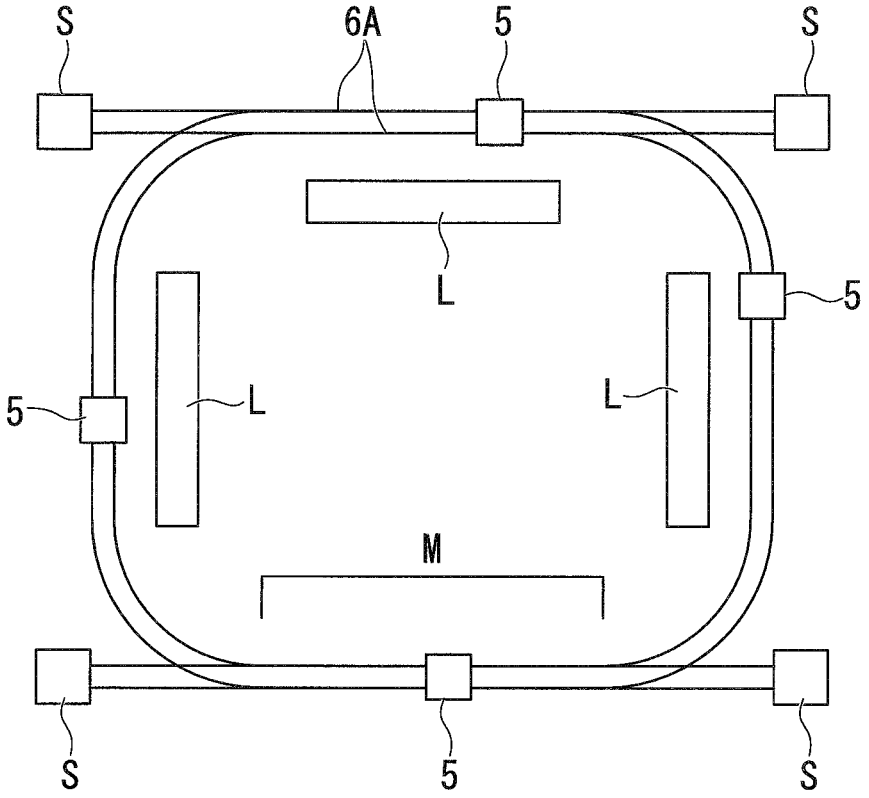
FIG. 9 is a schematic diagram illustrating a main part constitution of a heat treatment system according to another embodiment of the present disclosure.

For example, as shown in FIG. 9, conveying rails 6A may be formed in a loop shape including a plurality of linear portions and rows L constituted of carburizing furnaces 7A to 7F and a gas cooling furnace 8 shown in FIG. 1 may be installed along the plurality of linear portions inside the loop. In this case, a plurality of cooling and conveying devices 5 according to the number of the rows L are disposed on the conveying rails 6A and heat treatment is performed on objects to be treated X among the carburizing furnaces 7A to 7F and the gas cooling furnace 8 in each of the rows L by selectively using a cooling and conveying device 5 from the plurality of cooling and conveying devices 5 according to conditions. Furthermore, the above-described spaces S can be provided on the conveying rails 6A or a part (a portion indicated by a reference numeral M in FIG. 9) of the conveying rails 6A can be used for maintenance of the cooling and conveying device 5 as described above. In the case of FIG. 9, the three rows L constituted of carburizing furnaces 7A to 7F and the gas cooling furnace 8 are installed, four cooling and conveying devices 5 are disposed on the conveying rails 6A, three cooling and conveying devices 5 are used for heat treatment performed on each of the objects to be treated X, and one cooling and conveying device 5 is used for maintenance.

In the example of FIG. 9, the roller conveyors 1A to 1E, the pre-washing machine 2, the turntables 3A and 3B, the delivery devices 4A and 4B, the transfer device 9, the post-washing machine 10, the continuous tempering furnace 11, and the like are appropriately installed outside the above-described loop. On the other hand, in the example of FIG. 9, the rows L constituted of the carburizing furnaces 7A to 7F and the gas cooling furnace 8 may be installed along the above-described linear portions outside the loop and the roller conveyors 1A to 1E, the pre-washing machine 2, the turntables 3A and 3B, the delivery devices 4A and 4B, the transfer device 9, the post-washing machine 10, the continuous tempering furnace 11, and the like may be installed inside the above-described loop.

INDUSTRIAL APPLICABILITY

In heat treatment performed on objects to be treated, a temperature history when cooling treatment is performed on each of the objects to be treated can be managed more accurately than in the related art.

What is claimed is:

1. A heat treatment system comprising:

a plurality of heating chambers arranged in a row and configured to perform heat treatment on an object to be treated;

a conveying rail provided along the plurality of heating chambers;

a conveyance device configured to load the object to be treated into the plurality of heating chambers, unload the object to be treated from the plurality of heating chambers, and convey the object to be treated under an oxygen-free atmosphere, while moving on the conveying rail; and a delivery device that is provided such that the delivery device is disposed on one side of two sides of the conveying rail and the plurality of heating chambers are disposed on the other side of the two sides of the conveying rail, and delivers and receives the object to be treated to and from the conveyance device, wherein the conveyance device includes a cooling device configured to perform cooling treatment on the object to be treated.

2. The heat treatment system according to claim 1, wherein the cooling device includes an oil cooling device configured to cool the object to be treated using a predetermined cooling oil, and a gas cooling device configured to cool the object to be treated using a predetermined cooling gas.

* * * * *